US009295347B2

(12) United States Patent
Mackay

(10) Patent No.: US 9,295,347 B2
(45) Date of Patent: Mar. 29, 2016

(54) HINGE CLIP

(71) Applicant: Geoffrey D. C. Mackay, Ottawa (CA)

(72) Inventor: Geoffrey D. C. Mackay, Ottawa (CA)

( * ) Notice: Subject to any disclaimer, the term of this patent is extended or adjusted under 35 U.S.C. 154(b) by 59 days.

(21) Appl. No.: 14/206,446

(22) Filed: Mar. 12, 2014

(65) Prior Publication Data

US 2015/0257553 A1 Sep. 17, 2015

(51) Int. Cl.

| | |
|---|---|
| ***A47G 1/16*** | (2006.01) |
| ***E05D 7/12*** | (2006.01) |
| *E05D 3/04* | (2006.01) |
| *E05D 5/02* | (2006.01) |

(52) U.S. Cl.

CPC *A47G 1/164* (2013.01); *E05D 7/12* (2013.01); *E05D 3/04* (2013.01); *E05D 5/02* (2013.01); *E05Y 2600/502* (2013.01); *Y10T 16/5285* (2015.01); *Y10T 16/534* (2015.01)

(58) Field of Classification Search

CPC . Y10T 16/522; Y10T 16/528; Y10T 16/5285; Y10T 16/534; Y10T 16/558; Y10T 24/20; Y10T 24/44291; Y10T 24/44376; Y10T 24/4447; Y10T 24/44564; E05D 5/02; E05D 5/04; E05D 5/06; E05D 7/00; E05D 7/12; E05D 3/04; B42F 9/00; G09F 1/10; G09F 1/12; A47G 1/164; E05Y 2600/502

USPC ..... 16/223, 231, 232, 252, 387; 24/67 R, 24/489, 499, 510, 521; 40/647

See application file for complete search history.

(56) References Cited

U.S. PATENT DOCUMENTS

| | | | | |
|---|---|---|---|---|
| 1,900,425 | A * | 3/1933 | Benjamin | 63/20 |
| 4,807,334 | A | 2/1989 | Blanchard | |
| 4,899,974 | A | 2/1990 | Wear et al. | |
| 5,440,791 | A | 8/1995 | Guio | |
| 7,739,820 | B2 * | 6/2010 | Frank | 40/647 |
| 8,887,354 | B1 * | 11/2014 | Weinman | 16/252 |
| 2005/0210633 | A1 * | 9/2005 | Thomson et al. | 24/67 R |
| 2008/0308589 | A1 * | 12/2008 | Graham | 224/191 |

FOREIGN PATENT DOCUMENTS

CA 2542696 A1 10/2006

OTHER PUBLICATIONS

International Search Report and Written Opinion from International Application No. PCT/CA2015/050180, dated Jun. 15, 2015, 7 pp.

* cited by examiner

*Primary Examiner* — William Miller
(74) *Attorney, Agent, or Firm* — Shumaker & Sieffert, P.A.

(57) ABSTRACT

A hinge clip comprises a mounting member hingedly connected to a support surface. A contact member is pivotally coupled to the support member and biased towards a closed position. An object can be retained between the support member and the contact member. The hinge clip allows album covers or other artworks to be used as doors of openings, or to be displayed on walls.

12 Claims, 7 Drawing Sheets

HINGE CLIP

TECHNICAL FIELD

The current description relates to hinges and in particular to hinges incorporating a clip.

BACKGROUND

Record album covers (LP/EP), compact disc (CD) covers, digital video disc (DVD), Blu-Ray™ disc covers often have artwork that owners may wish to display. However, there are limited number of options for conveniently displaying the covers.

BRIEF DESCRIPTION OF THE DRAWINGS

Features, aspects and advantages of the present disclosure will become better understood with regard to the following description and accompanying drawings in which.

DETAILED DESCRIPTION

Figure 1:
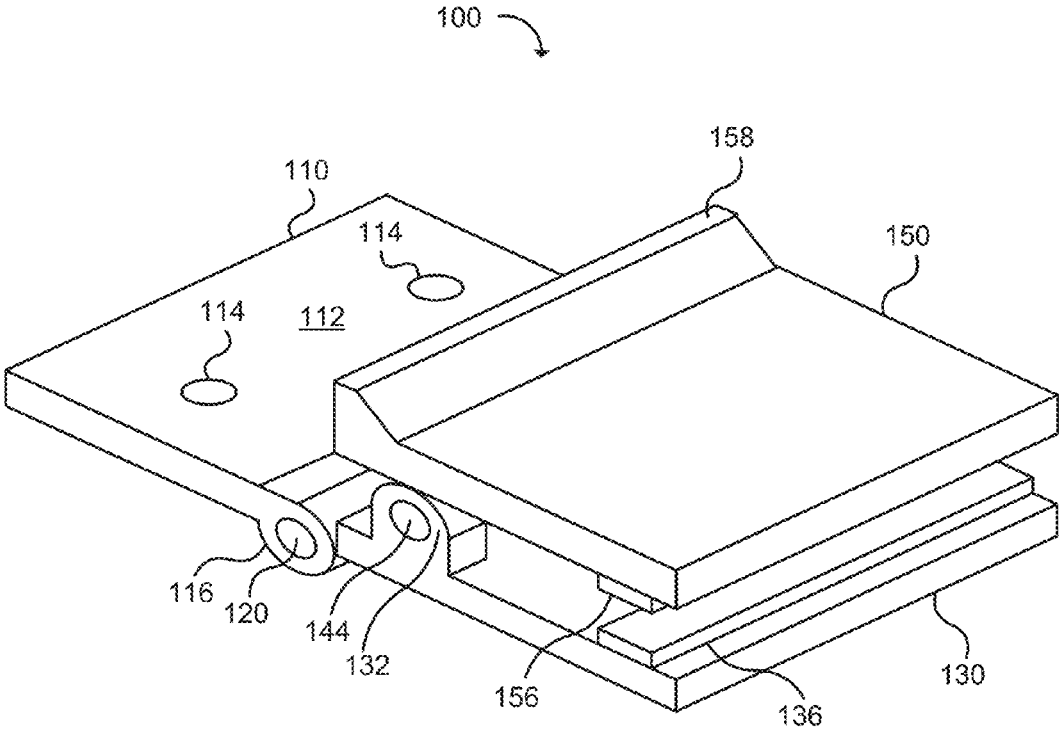
FIG. 1 depicts an isometric view of a hinge clip.

In accordance with the present disclosure there is provided a hinge clip comprising: a mounting member having a mounting surface; a support member pivotally connected to the mounting member and comprising a contacting surface; and a contact member coupled to the support member, the contact member comprising a second contacting surface aligned with the contacting surface of the support member, the contact member moveable between: a contact position for retaining an object between the contacting surface of the support member and the second contacting surface of the contact member; and a release position for releasing the object from between the contacting surface of the support member and second contacting surface of the contact member; and a biasing member in contact with the contact member for biasing the contact member to the contact position.

In a further embodiment, the support member is pivotally connected to the mounting member at a first edge of the mounting member.

In a further embodiment, the pivotal connection between the mounting member and the support member comprises a hinged connection.

In a further embodiment, the support member is pivotally connected to the mounting member along an edge of the support member.

In a further embodiment, the mounting member comprises one or more mounting points for securing the mounting member to a surface.

In a further embodiment, the contact member is pivotally connected to the support member.

In a further embodiment, each of the contact member and support member comprise protrusions extending from facing surfaces, each of the protrusions having aligned holes for receiving a connecting pin for connecting the contact member and support member.

In a further embodiment, the biasing member comprises a spring surrounding the connecting pin.

In a further embodiment, the biasing member comprises a spring.

In a further embodiment, the biasing member is a resilient member.

In a further embodiment, the contacting surface of the support member and the second contacting surface of the contact member each comprise a rubberized member for contacting the object.

In a further embodiment, wherein the mounting member is generally rectangular in shape.

In a further embodiment, the support member is generally rectangular in shape.

In a further embodiment, the contact member is generally rectangular in shape.

A hinge clip is described that can provide a convenient hinge for releasably holding an album cover, or other piece of artwork. As described further herein, the hinge clip comprises a hinged connection that allows the mounted album cover to be used as, for example, a door to a cabinet or cubby opening. The hinge clip comprises a clip that releasably holds the cover or artwork, allowing the cover or artwork to be easily removed or repositioned. Additionally, the hinge clip may also be used as a mounting device for releasably mounting album covers, or artwork to a surface for display.

When displaying album covers or artwork, either as artwork mounted to a wall for display, or as a door to a cabinet, shelving unit or cubby, it may be desirable to allow for the album cover or artwork to be easily removed. For example, although an album cover may be displayed, it may still be desirable to be able to remove the album from the cover in order to listen to the album. Further, it may be desirable to periodically change the album covers or artwork held by hinge clips in order to change the album covers or artwork displayed.

The hinge clip described further herein may be used to support a variety of objects such as record album covers (LP/EP), compact disc (CD) covers, digital video disc (DVD) covers, high definition DVD (HD-DVD) covers, Blu-Ray™ covers, photographs, artwork, as well as display devices. Although the hinge clip may support a wide variety of objects, the hinge clip is described further below as simply supporting an object for brevity.

Figure 2:
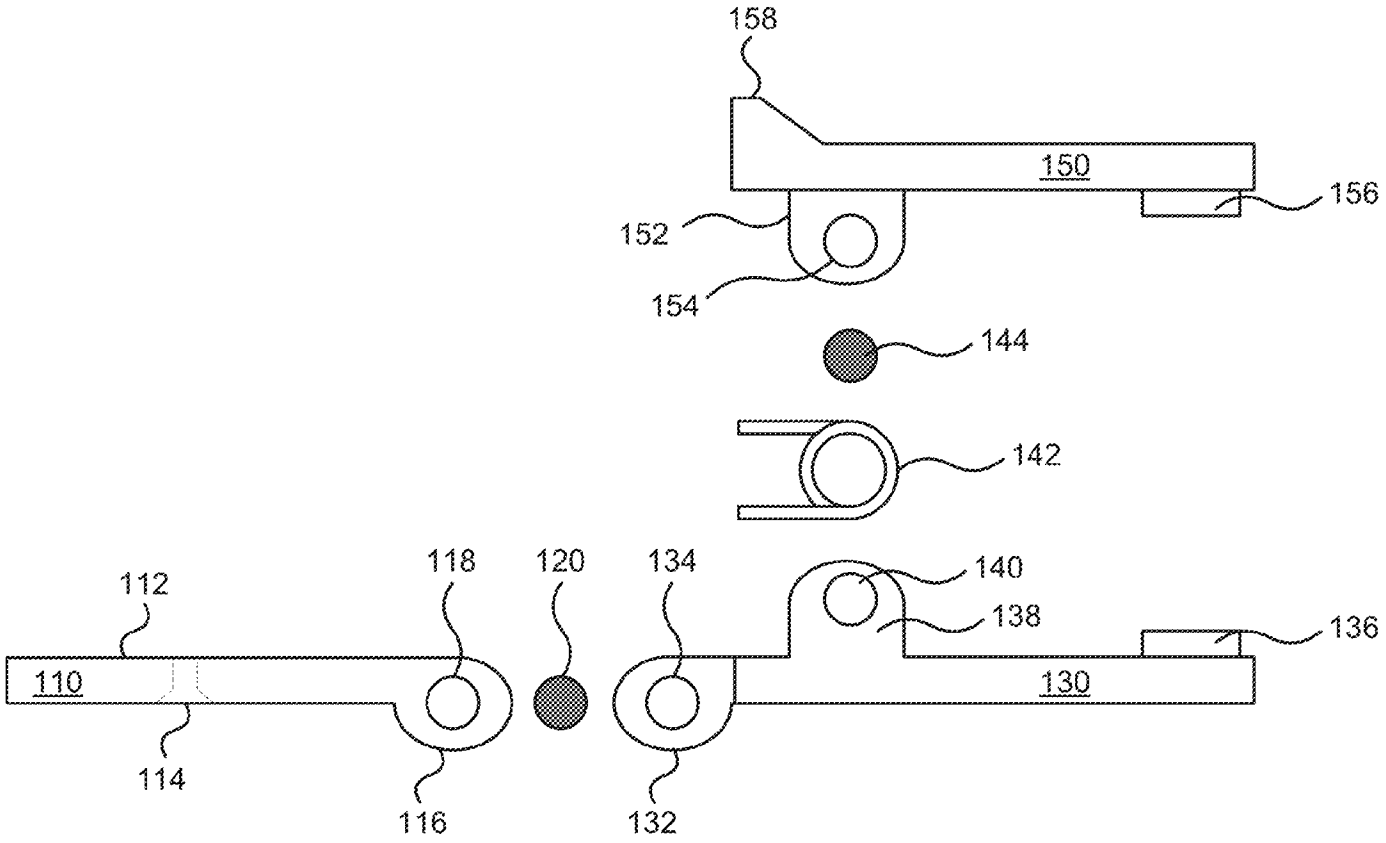
FIG. 2 depicts an exploded view of the hinge clip.

FIG. 1 depicts an isometric view of a hinge clip, and FIG. 2 is an exploded view of the hinge clip. The hinge clip 100 comprises three main components coupled together. In particular, the hinge clip 100 comprises a mounting member 110 that is coupled to a support member 130. The mounting member 110 may comprise a mounting surface 112 that has one or more screw holes 114 for securing the hinge clip 100 to another surface. The screw holes 114 may be provided as depicted, or may have a keyhole, or pear shape in order to facilitate the mounting of the hinge clip to a surface using other fasteners such as nails. Further, the mounting surface 112 may include an adhesive material and/or a cushioning material to reduce marring or scratching of the surface and/or to allow mounting of the hinge clip to a variety of surfaces that may not receive screws or nails. The coupling between the mounting member 110 and the support member 130 allows the support member 130 to rotate about an edge of the mounting member 110. As depicted in FIG. 1, the coupling between the mounting member 110 and the support member 130 may be provided by a hinged connection comprising one or more knuckles 116 on the mounting member 110 connected to one or more knuckles 132 on the support member 130 by one or more pins 120. The one or more pins 120 fit through respective holes 118, 134 in each of the knuckles 116, 132 to couple the support member 130 to the mounting member 110.

Although described as being coupled together through knuckles 116, 132 and pins 120, it will be appreciated that the support member 130 and the mounting member 110 may be coupled together in various ways that allow the two members to rotate relative to each other. The support member 130 is pivotally coupled to the mounting member 110 along a first edge of the mounting member 110.

The support member 130 comprises a contacting surface 136 located adjacent to an edge of the support member 130 opposite from the edge connected to mounting member. The support surface 136 may be provided by a rubberized member or a gel member such as a silicon material. The support surface 136 may be provided as a separate component that is affixed to the support member 130. Additionally or alternatively, the support surface 130 may be manufactured in an over-molding process. The support surface 136 may provide a pliable surface that can securely contact the object without damaging the surface. The support member 130 is moveably coupled to a contact member 150. The contact member 150 has a second support surface 156 that is aligned with the support surface 136 of the support member 130.

The moveable connection may be provided by a pivotal connection between the support member 130 and the contact member 150. The support member 130 may include a protrusion 138 extending from the support member 130. The protrusion 138 has a hole 140 that aligns with a corresponding hole 154 in a protrusion 152 extending from the contact member 150. A pin 144 connects the support member 130 and the contact member 150 together. The contact member 150 may rotate about the pin 144 between to allow the object to be held or removed from the hinge clip 100. The contact member may have a lever or other releasing member 158 that extends past the point of rotation to facilitate rotation of the contact member 150. A biasing member may be located between the support member 130 and the contact member 150 in order to bias the contact member towards the support member 130. As depicted in FIG. 2, the biasing member may comprise a spring 142 that may be positioned around the pin, with one end contacting the support member 130 and the other end contacting the contact member 150.

Figure 3:
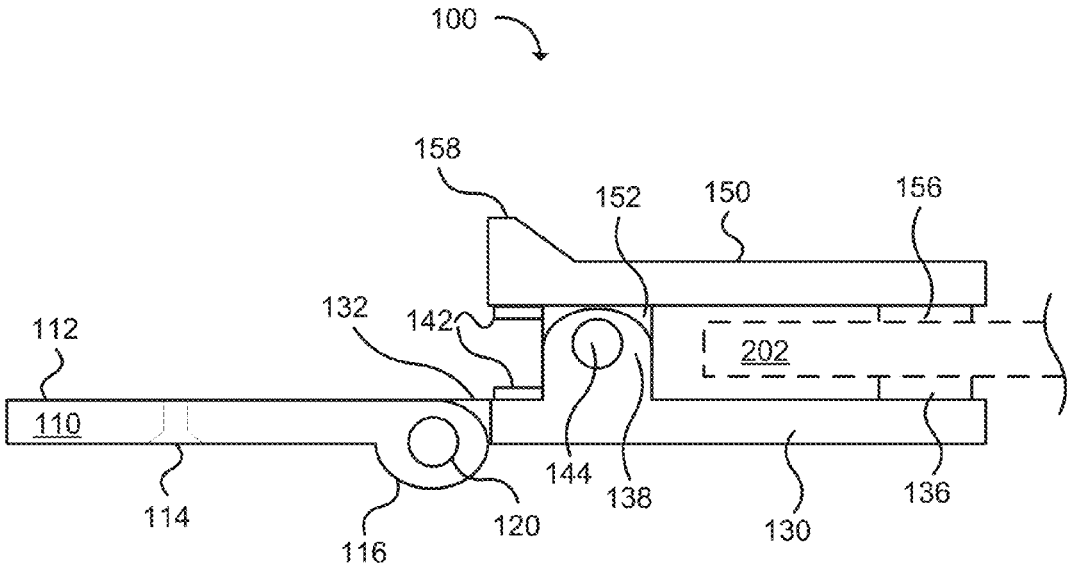
FIG. 3 depicts a side view of the hinge clip.

FIG. 3 depicts the hinge clip 100 described above in a contact position. The contact position retains an object 202 between the contacting surface 136 of the support member 130 and the second contacting surface 156 of the contact member 150. The biasing member 142 biases the contact member toward the support member 130 so that the object is retained between the two contact surfaces 136, 156. The biasing member 142 may be selected to provide sufficient force for retaining the object 202 between the contact surface 136 and the second contact surface 156.

Figure 4:
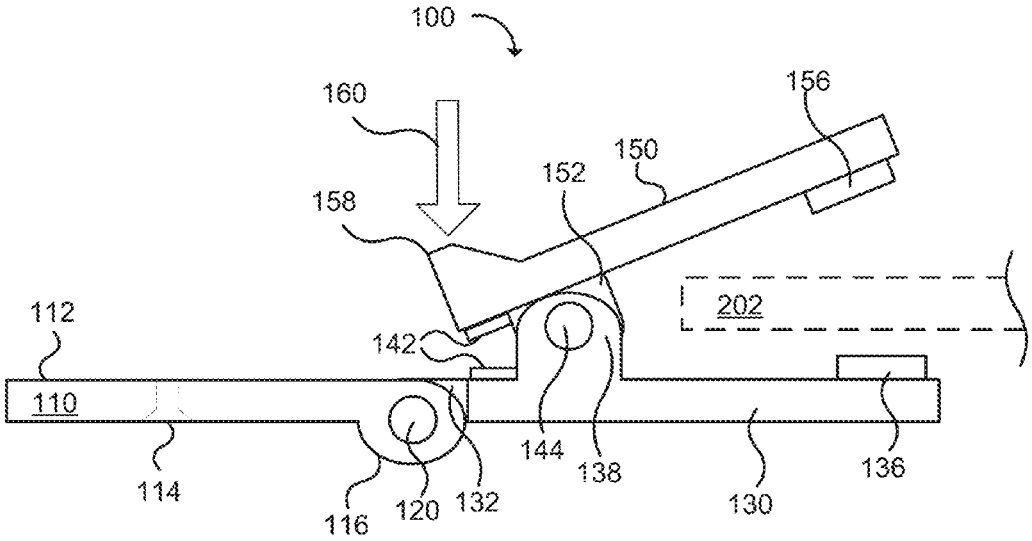
FIG. 4 depicts a further side view of the hinge clip.

FIG. 4 depicts the hinge clip 100 described above in a release position. The release position allows the object to be removed from between the contacting surface 136 of the support member 130 and second contacting surface 156 of the contact member 150. A force 160, greater than the biasing force supplied by the bias member 142, is applied to the releasing member 158 in order to rotate the contact member 150 away from the support member 130 and allow the object to be removed.

Figure 5:
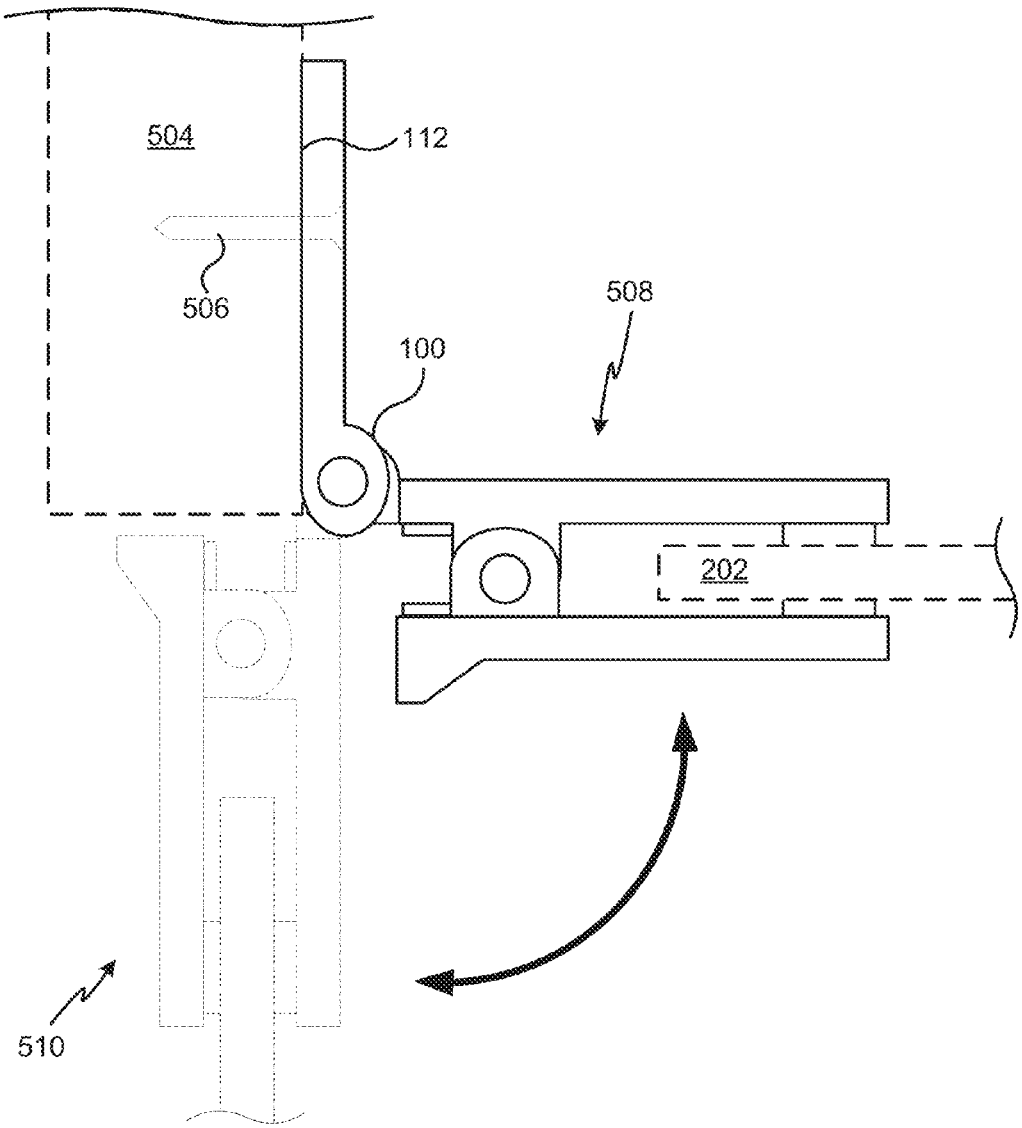
FIG. 5 depicts the hinge clip in use.

FIG. 5 depicts the hinge clip in use. The hinge clip 100 is depicted being used as a door hinge for a cabinet, cubby, drawer or similar opening, referred to further herein as the opening for brevity. The mounting surface 112 of the hinge clip is secured to a side surface 504 of the opening. The hinge may be fixed to the side surface 504 using an adhesive, nails and/or screws 506. When the hinge clip 100 is mounted to the opening, an object 202 inserted between the contact surfaces and retained by the biasing force applied by the biasing means may provide a hinged door to the opening. With the hinge clip 100 mounted and the object 202 secured in between the contact surfaces, the hinge clip can be rotated between a closed position 508, in which the object covers the opening and an open position 510 depicted by dotted lines in which the opening may be accessed.

Figure 6:
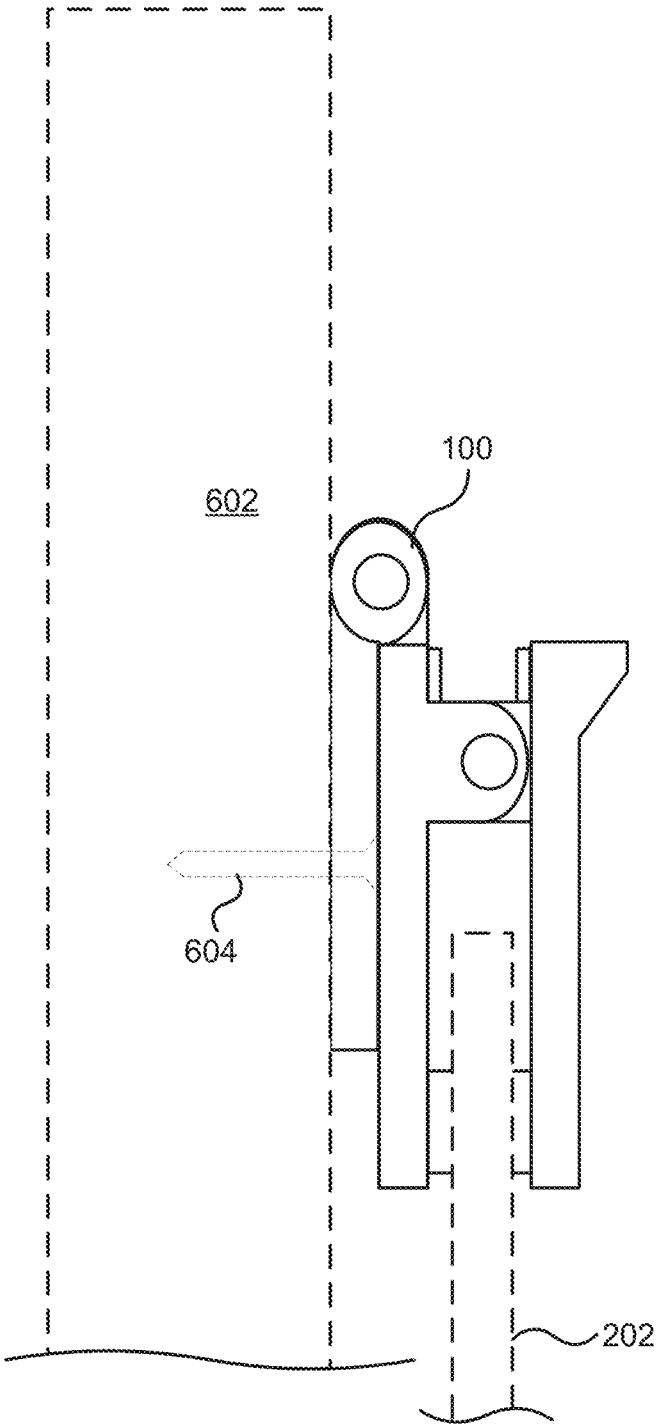
FIG. 6 depicts the hinge clip in use.

FIG. 6 depicts the hinge clip in use. As depicted, the hinge clip 100 may be used in mounting objects to a wall or display surface. The mounting surface of the mounting member may be secured to a wall 602, for example by a screw 604. With the mounting member secured to the wall, the support member can be hinged down over the mounting member and the object 202 can be secured between the contacting surfaces of the support member and the contact member.

Figure 7:
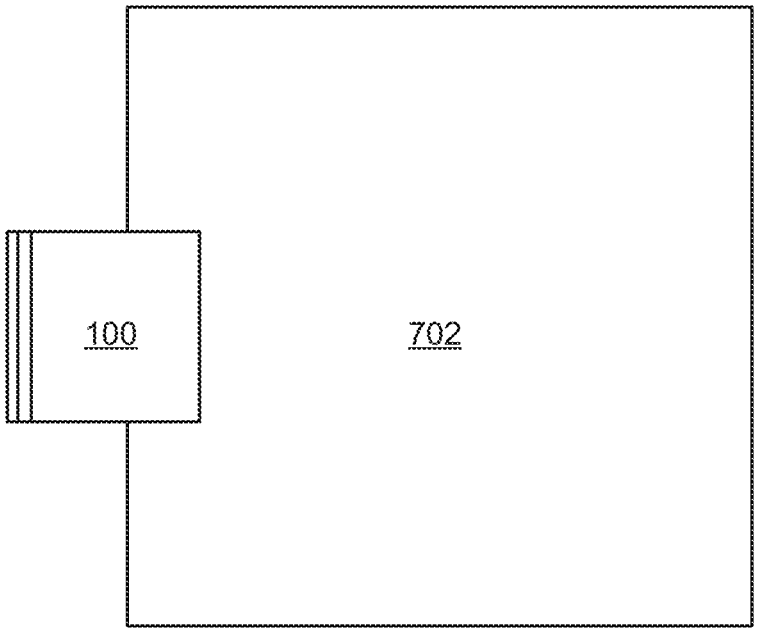
FIG. 7 depicts a front view of the hinge clip with an album cover.

FIG. 7 depicts a front view of the hinge clip with an object. As depicted, the hinge clip 100 may securely hold the object 702 along one side of the object. Although only one hinge clip is depicted, it will be appreciated that one or more hinge clips may be used to secure an object depending upon the size and weight of the object.

The hinge clip described above may be made of varying materials and of varying sizes and shapes without departing from the teachings described above. For example, the hinge clip may be made from a clear hard plastic in order to allow the object to be visible under the hinge clip. Alternatively, the hinge clip may be made from a translucent or opaque plastic material, wood or metal.

As described, the hinge clip allows an object such as artwork, record albums or CD covers to be used as a door to a cabinet, shelving unit or cubby, or to be displayed. It is contemplated that the hinge clip may be used with other types of objects including for example, works of art on various mediums; educational boards/white boards; instructional signs; inventory signs which may be indicative of contents of a shelf; photographs on various mediums; and name/property tags.

Although the above has described various specific embodiments, variations and modifications may be made to the above-described embodiments based on the teachings of the current specification. All such modifications and variations are intended to be included herein within the scope of this disclosure. The scope of the appended claims should not be limited by the specific embodiments set forth, but should be given the broadest interpretation consistent with the teachings of the description as a whole.

What is claimed is:

1. A hinge clip comprising:

a mounting member having a mounting surface;

a support member pivotally connected to the mounting member and comprising a first contacting surface; and a contact member pivotally connected the support member, the contact member comprising a second contacting surface aligned with the first contacting surface of the support member, the contact member moveable between:

a contact position for retaining an object between the first contacting surface of the support member and the second contacting surface of the contact member; and a release position for releasing the object from between the first contacting surface of the support member and second contacting surface of the contact member; and a biasing member in contact with the contact member for biasing the contact member to the contact position, wherein each of the contact member and support member comprise protrusions extending from facing surfaces, each of the protrusions having aligned holes for receiving a connecting pin for connecting the contact member and support member.

2. The hinge clip of claim 1, wherein the support member is pivotally connected to the mounting member at a first edge of the mounting member.

3. The hinge clip of claim 1, wherein the pivotal connection between the mounting member and the support member comprises a hinged connection.

4. The hinge clip of claim 1, wherein the support member is pivotally connected to the mounting member along an edge of the support member.

5. The hinge clip of claim 1, wherein the mounting member comprises one or more mounting points for securing the mounting member to a surface.

6. The hinge clip of claim 1, wherein the biasing member comprises a spring surrounding the connecting pin.

7. The hinge clip of claim 1, wherein the biasing member comprises a spring.

8. The hinge clip of claim 1, wherein the biasing member is a resilient member.

9. The hinge clip of claim 1, wherein the first contacting surface of the support member and the second contacting surface of the contact member each comprise a rubberized member for contacting the object.

10. The hinge clip of claim 1, wherein the mounting member is generally rectangular in shape.

11. The hinge clip of claim 1, wherein the support member is generally rectangular in shape.

12. The hinge clip of claim 1, wherein the contact member is generally rectangular in shape.

* * * * *